United States Patent [19]

Hall, Sr.

[11] Patent Number: 4,846,515

[45] Date of Patent: Jul. 11, 1989

[54] GOLF BALL RETRIEVING APPARATUS

[76] Inventor: James R. Hall, Sr., Rte. 2, Box 298, Riceville Rd., Asheville, N.C. 28805

[21] Appl. No.: 202,364

[22] Filed: Jun. 6, 1988

[51] Int. Cl.[4] ..... A63B 47/02

[52] U.S. Cl. ..... 294/19.2; 294/99.1

[58] Field of Search ..... 294/19.1, 19.2, 33, 294/99.1, 100, 119.3; 81/53.11, 53.12; 273/32 D, 32 F, 162 E

[56] References Cited

U.S. PATENT DOCUMENTS

| | | | |
|---|---|---|---|
| 1,175,035 | 3/1916 | Wooster | 294/19.2 X |
| 1,535,029 | 4/1925 | Murch | 294/19.2 X |
| 1,960,110 | 5/1934 | Iles | 294/19.2 X |
| 2,607,620 | 8/1952 | Oliveri | 81/53.11 X |
| 2,766,060 | 10/1956 | Fuller | 81/53.11 |
| 3,086,805 | 4/1963 | Dardaine et al. | 294/100 X |
| 3,136,573 | 6/1964 | Harke | 294/19.2 |
| 3,442,544 | 5/1969 | Faber | 294/19.2 |
| 3,473,423 | 10/1969 | Peck | 81/53.12 X |
| 3,841,639 | 10/1974 | Werner | 294/19.2 X |

FOREIGN PATENT DOCUMENTS

| | | | |
|---|---|---|---|
| 1429211 | 1/1966 | France | 294/19.2 |
| 207138 | 11/1923 | United Kingdom | 294/19.2 |
| 2035185 | 1/1980 | United Kingdom | 294/19.2 |

*Primary Examiner*—Johnny D. Cherry

*Attorney, Agent, or Firm*—Pitts and Brittian

[57] ABSTRACT

A golf ball retrieving apparatus (10) for gripping and holding a golf ball (34) is provided. The apparatus (10) includes an elongated handle (12) which can be held by one hand and readily received within a golfer's bag. A retention member (22) is mounted at the distal end of the handle (12) and defines a first cavity (26) open at one end. This cavity (26) receives a gripping member (30) which is releasably mounted, in the preferred embodiment, within the first cavity (26) of the retention member (22). The gripping member (30) comprises a compressible foam in the preferred embodiment defining a further cavity (32) proportioned for receiving and holding a golf ball (34) therein.

7 Claims, 3 Drawing Sheets

GOLF BALL RETRIEVING APPARATUS

DESCRIPTION

TECHNICAL FIELD

This invention relates to a golf ball retrieving apparatus, and more particularly concerns such an apparatus which is light weight and which can be held and used by one hand of a golfer.

BACKGROUND ART

Golf ball retrieving apparatuses have heretofore been known and have assumed various configurations. Such devices commonly include an elongated handle which carry at the outboard end portion, a member or device which engages a golf ball. Such devices are used for retrieving golf balls from water or areas of vegetation from which a user desires to keep his distance. The device which grips the ball commonly includes a mechanical member at the outboard end portion which holds the golf ball until it is removed by the user.

Known prior art golf ball retrievers suffer certain disadvantages. For example, the devices generally include a complex mechanical connector or member which engages the golf ball. This connector is often manipulated from the proximal handle portion such that the enclosure operation serving to grip the golf ball is performed by the user's second hand, the first hand being used to hold the handle itself. Moreover, the devices may be relatively heavy or incorporate mechanical components which can become deformed (such as springs) or wear out during use and rendered ineffective. Known prior art devices are disclosed in the following U. S. Pat. Nos.: 1,722,519, issued to J. R. DuChene on July 30, 1929; 1,830,520, issued to H. E. Moyses on November 3, 1931; 3,149,872, issued to P. W. Ward on Sept. 22, 1964; 3,442,544, issued to S. Faber on May 6, 1969; 3,901,545, issued to M. Shott on Aug. 26, 1975; 3,982,781, issued to W. J. Tucker, et al., on Sept. 28, 1976; 4,021,068, issued to A. F. Piazza on May 3, 1977; 4,046,413, issued to J. Jeninga on Sept. 6, 1977; 4,063,769, issued to R. Zimmer on Dec. 20, 1977; 4,313,632, issued to G. T. King, et al., on Feb. 2, 1982; 4,334,707, issued to C. S. Phillips on June 15, 1982; and 4,693,473, issued to E. E. Miller on Sept. 15, 1987.

Accordingly, it is an object of the present invention to provide an improved golf ball retrieving apparatus which is light weight and readily fits within the golfer's bag.

Another object of the present invention is to provide such a retrieving apparatus which is simple to construct and incorporates a gripping and holding piece which can be readily replaced after it becomes worn by use.

Another object of the present invention is to provide a device which can be used to retrieve golf balls from remote locations such as water by having the rolling action of the golf ball against its supporting surface serve to cause the golf ball to enter into the gripping member.

Yet another object of the present invention is to provide such an apparatus from which the golf ball can be readily removed.

Other objects and advantages of the present invention will become apparent upon reading the detailed description together with the drawings as described as follows.

DISCLOSURE OF THE INVENTION

In accordance with various features of the invention, an improved golf ball retrieving apparatus is provided. The apparatus is light weight and is designed to be readily received in the bag of a golfer such that the gripping and holding portion of the device extends from the bag and is positioned proximate the positions of the club heads. The gripping and holding portion of the device defines a cavity in the preferred embodiment which is open at one end. A gripping member is received within this cavity and comprises a portion of foam defining a further cavity that receives and holds a golf ball therein. This further cavity is preferably defined by a closed-cell foam which exerts expansion forces against the surface of the golf ball to retain it therein after the foam has been compressed during the golf ball insertion.

BEST MODE FOR CARRYING OUT THE INVENTION

Figure 1:
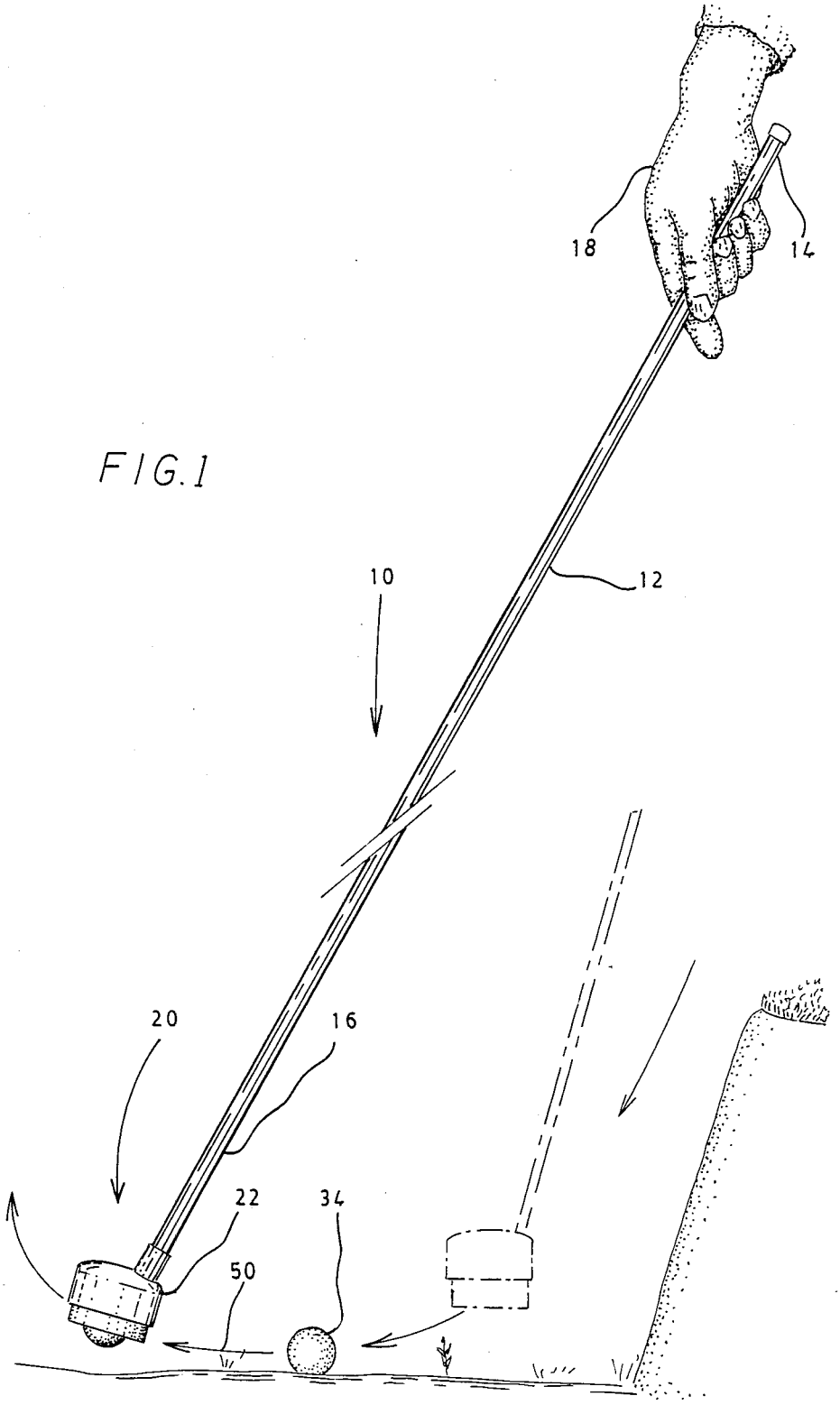
FIG. 1 illustrates a golf ball retrieving apparatus constructed in accordance with various features of the preferred invention. This figure also shows in phantom lines the motion commonly used for causing the golf ball to be received within the gripping member.

A golf ball retrieving apparatus constructed in accordance with various features of the present invention is illustrated generally at 10 in FIG. 1. The apparatus 10 includes an elongated handle 12 having a proximal end portion 14 and a distal end portion 16. The handle 12 is preferably fabricated from a light weight tubular material such as PVC or other suitable plastic pipe, semi-rigid composition. The proximal end portion of the handle is provided with a suitable cap as illustrated, which is optional. This proximal end portion is designed to be gripped by a user's hand 18 for manipulating the apparatus 10 during a retrieving operation.

A golf ball gripping and holding means is mounted at the distal end portion 16 of the handle 12. This gripping and holding means is generally illustrated at 20 in FIG. 1, and includes a retention member 22 which is secured to the end portion 16 of the handle 12. In this connection, the retention member 22 includes a sleeve 24 (see FIG. 2) which receives the distal end portion 16 of the handle 12. This sleeve 24 is preferably secured to the outer surface of the retention member 22. As is necessary, or desired, the sleeve 24 can be integrally formed with the retention member 22.

The retention member 22 is cup-shaped in the illustrated embodiment, and defines a cavity therein shown at 26 in FIGS. 2–5. This cavity 26 has a substantially cylindrical configuration and opens at lower end portion 28 of the retention member 22. The retention member 22 and the sleeve 24 are preferably fabricated from a rigid or semi-rigid material such as PVC such that the cavity 26 has a substantially fixed cross-sectional outline.

A gripping member 30 is mounted within the cavity 26 defined in the retention member 22. This gripping member 30 comprises a compressible material in the preferred embodiment, and defines a further cavity 32 shown in FIGS. 4 and 5. This cavity 32 is proportioned for receiving and holding a golf ball 34.

In the preferred embodiment, the gripping member 30 comprises a tubular shaped foam piece or means having an outside diameter proportioned for being received within the cavity 26 defined in the retention member 22. In the preferred embodiment, the foam comprises Type A closed-cell foam of Durometer 7. In order to fit the gripping member 30 into the cavity 26, the foam piece is compressed such that the natural expansive forces of the foam tend to expand the outside diameter of the gripping member and biases it against the walls of the retention member cavity 26. These forces hold the gripping member within this cavity 26 and allow it to be releasably and slidably mounted therein. In this connection, it can be readily replaced after being worn by use.

The cavity 32 of the gripping member 30 has an internal diameter which is proportioned such that it is less than the diameter of a golf ball. In this connection, a golf ball can be received within the cavity 32 such that the expansive forces of the compressed foam serve as gripping forces against the ball to hold and retain it therein.

Figure 2:
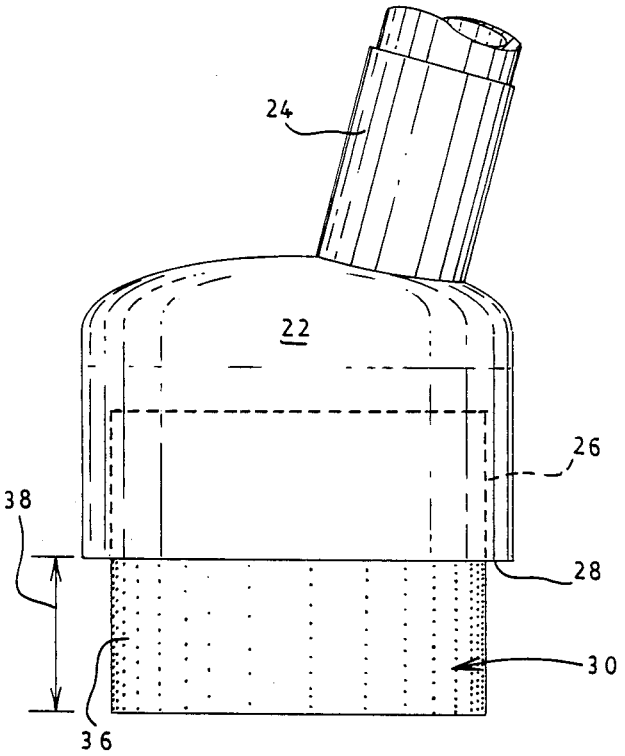
FIG. 2 illustrates an elevation view of the retention and gripping members mounted at the distal end portion of the handle, with a portion of the handle broken away for clarity.
Figure 3:
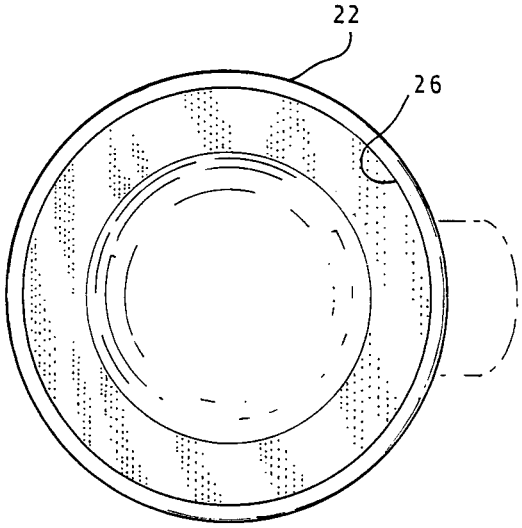
FIG. 3 illustrates a bottom view of the portion of the device shown in FIG. 2.
Figure 4:
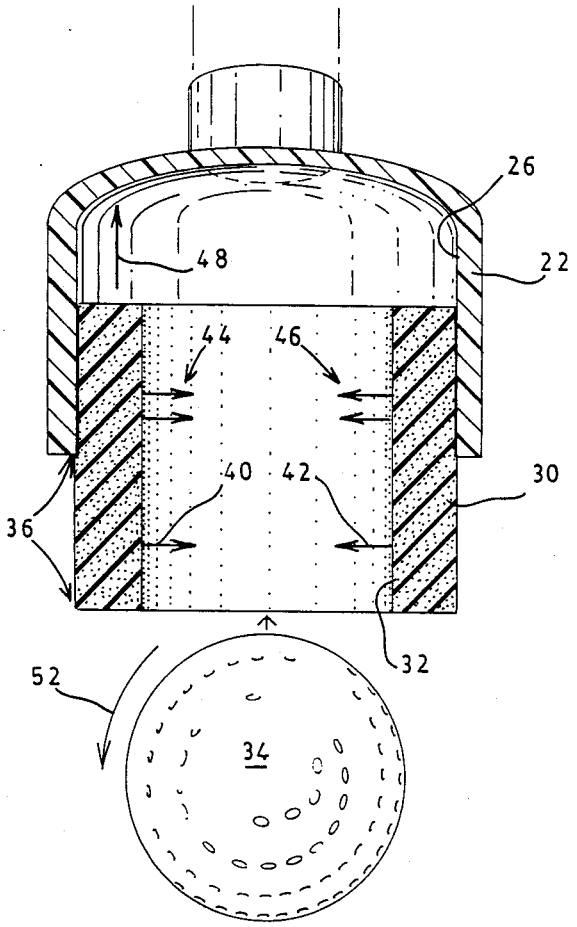
FIG. 4 depicts a cross-sectional view of the gripping and holding portion of the device prior to a golf ball being received therein.
Figure 5:
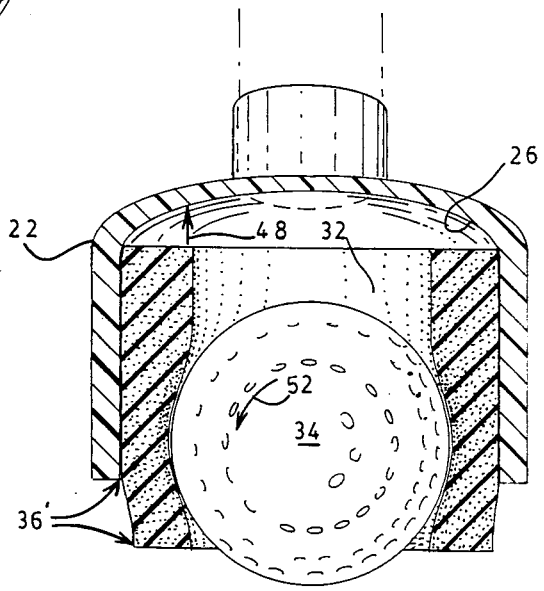
FIG. 5 illustrates a portion of the device shown in FIG. 4 after the golf ball has been received.

As is shown in FIGS. 2, 4 and 5, the gripping member 30 includes a portion 36 designated between the limits of the bi-directional arrow 38 which extends outwardly from the lower end portion 28 of the retention member 22. Thus, the foam of the gripping member 30 is partially received within the cavity 26. In this connection, when the gripping member 30 as is shown in FIGS. 4 and 5 is constructed from a tubular foam piece, the portion 36 of the gripping member 30 will exert less gripping action on the ball than the portion of the foam received within the cavity 26. More specifically, referring to FIG. 4, the portion 36 of the gripping member 30 extending outwardly from the lower edge 28 of the retention member 22 will exert less gripping forces (and enhance the ease with which the ball is inserted into cavity 32) indicated by the arrows 40 and 42 than the gripping forces indicated by the arrows 44 and 46. This feature is due to the fact that the outward expansion of the gripping member 30 is unrestricted at its portion 36. However, the walls of the retention member 22 defining the cavity 26 restrict the outward expansion of the portion of the gripping member 30 within the cavity 26. This restriction causes the portion of the gripping member within the cavity to exert greater gripping forces as indicated by the arrows 44 and 46 against the golf ball 34. Thus, the gripping forces acting on the golf ball increase (as indicated by the arrows 40, 42 and 44, 46) as the golf ball advances into the cavity 32 defined by the gripping member 30.

A further feature of the present invention is illustrated by looking at FIGS. 4 and 5 in conjunction. It will be noted in FIG. 4 that the portion 36 of the gripping member 30 extending outwardly from the lower edge 28 of the retention member 22 is of greater length than the portion 36' of such gripping member extending outwardly from the retention member after the ball 34 has advanced into the cavity 32 during a gripping operation. This is due to the fact that the gripping member 30 is designed such that it can slide into the cavity 26 in the direction of the arrow 48 (see FIGS. 4 and 5). Thus, as the ball moves into the cavity 32 and the gripping and holding means 20 is pressed downwardly, the gripping forces exerted on the ball are increased.

In the preferred operation, a user will place the gripping and holding means over the ball such that the cavity 32 is aligned therewith. Then, the apparatus 10 will be moved downwardly against the ball and in the direction of arrow 50 (see FIG. 1). As this occurs, the ball will rotate in the direction of arrow 52 (see FIG. 4) and roll into the cavity 32 as is shown by viewing FIGS. 4 and 5 together. Similarly, the ball can be removed from the cavity 32 by rolling it outwardly or by slidably removing the gripping member 30 from the retention member cavity 26, and then removing the ball therefrom.

From the foregoing description, it will be recognized that a golf ball retrieving apparatus designed for removing a golf ball from a remote location such as that indicated in FIG. 1, or from water, has been described and illustrated. The apparatus is designed to be light weight and fit into a golf bag in a manner similar to that of a regular golf club. As necessary, or desired, the handle can be fabricated such that it telescopes to allow adjustment of the handle length. The apparatus can be used by a single hand of a golfer, and does not require complex mechanical manipulators in order to grip and retrieve the ball. Moreover, in the preferred embodiment, the gripping member of the present device comprises a length of cylindrical and tubular foam defining a cavity therein. This tubular foam is slidably received within the cavity 26 defined in the retention member. It can be readily removed for replacement or for removing a golf ball therefrom. Further, the gripping member can be slidably advanced from the cavity 26 of the retention member 22 as shown in FIG. 4 to increase the length of the portion 36 extending outwardly from the lower end portion 28 of the retention member 22. This enhances the ease with which a ball can be inserted into the cavity 32 of member 30.

It is, of course, understood that although preferred embodiments of the present invention have been illustrated and described, various modifications thereof will become apparent to those skilled in the art and, accordingly, the scope of the present invention should be defined only by the appended claims and their equivalents thereof.

I claim:

1. A golf ball retrieving apparatus comprising:

an elongated handle; and a golf ball gripping and holding means mounted at a first end of said handle and including a retention member defining a first cavity closed at one end and open at one end, and a gripping member closely and releasably received within said first cavity through said open end, said gripping member comprising a compressible material defining a further cavity proportioned for receiving and holding a golf ball therein due to expansive forces of said compressible material.

2. The golf ball retrieving apparatus of claim 1 wherein said gripping member comprises a tubular shaped foam means having an outside diameter proportioned for being received within said first cavity of said retention member upon compression of said foam means such that expansive forces releasably hold said foam means within said first cavity, and wherein said foam means defines said further cavity having an internal diameter which is less than the diameter of a golf ball, such that a golf ball can be received within said further cavity and the expansive forces of said foam means serve as gripping forces against said golf ball to hold it.

3. The golf ball retrieving apparatus of claim 2 wherein said foam means partially extends from said first cavity such that said gripping forces on said golf ball increase as said golf ball advances into said further cavity defined by said foam means.

4. A golf ball retrieving device, which comprises:

an elongated handle having a proximal end for grasp by a user, and a distal end;

a body member attached to said distal end of said handle, said body member defining a first internal cylindrical cavity that is closed in a direction toward said handle and open ended in an opposite direction; and a ball gripping member of a compressible material closely and releasably received within said first cavity through said open end, said gripping member defining a substantially cylindrical further cavity having a diameter less than the diameter of said ball whereby entrance of said ball into said further cavity compresses said compressible material whereby said ball is held in said further cavity by expansive forces of said compressible material.

5. The device of claim 4 wherein said compressible material is a closed cell foam, and said gripping member is slidable within said first cavity in the absence of said ball and is closely held in said first cavity when said ball is in said further cavity.

6. The device of claim 4 wherein said gripping member partially extends from said first cavity such that gripping forces on said ball increase as said ball advances into said further cavity.

7. A golf ball retrieving device, which comprises:

an elongated handle having a proximal end for grasp by a user, and a distal end;

a cup-shaped body member attached to said distal end of said handle, said body member defining a first cylindrical cavity that is closed in a direction toward said handle and open ended in an opposite direction; and a ball-gripping member formed of closed cell foam means closely and slidably received within said first cavity through said open end, said foam means defining a cylindrical further cavity having a diameter less than the diameter of said ball whereby entrances of said ball into said further cavity compresses said foam means within said first cavity whereby said foam means is closely held in said first cavity and said ball is held in said further cavity, said foam means partially extending from said first cavity such that gripping forces on said ball increase as said ball advances into said further cavity.

* * * * *